US010239585B2

(12) United States Patent
Styke et al.

(10) Patent No.: US 10,239,585 B2
(45) Date of Patent: Mar. 26, 2019

(54) ROPE TENDER FOR WATERCRAFT

(71) Applicants: James Stanly Styke, Redford, MI (US); Terrence Robert Sobo, Cape Coral, FL (US)

(72) Inventors: James Stanly Styke, Redford, MI (US); Terrence Robert Sobo, Cape Coral, FL (US)

( * ) Notice: Subject to any disclaimer, the term of this patent is extended or adjusted under 35 U.S.C. 154(b) by 0 days.

(21) Appl. No.: 15/614,087

(22) Filed: Jun. 5, 2017

(65) Prior Publication Data

US 2018/0346073 A1 Dec. 6, 2018

(51) Int. Cl.
*B63B 21/04* (2006.01)
*B63B 21/00* (2006.01)

(52) U.S. Cl.
CPC ..... *B63B 21/04* (2013.01); *B63B 21/00* (2013.01); *B63B 2021/003* (2013.01); *B63B 2021/004* (2013.01); *Y10T 24/3916* (2015.01)

(58) Field of Classification Search
CPC ..... B63B 21/04; B63B 21/10; B63B 21/12; B63B 21/14; B63B 2021/003; B63B 21/54; Y10T 24/3922; Y10T 24/3998; Y10T 24/3916; Y10T 24/3931; Y10T 24/39; B66D 1/36
See application file for complete search history.

(56) References Cited

U.S. PATENT DOCUMENTS 2,833,240 A * 5/1958 Semolic ..... B63B 21/045 114/218
3,055,333 A * 9/1962 Ryan ..... B63B 21/04 114/210
4,173,194 A * 11/1979 McLaughlin ..... B63B 21/08 114/218
4,297,962 A * 11/1981 Johnson, Jr. ..... F16G 11/046 114/218
5,613,457 A * 3/1997 Frank ..... B63B 21/04 114/218
7,650,673 B2 * 1/2010 Jeffers ..... A01K 1/04 24/129 R
2018/0111664 A1 * 4/2018 Strube ..... B63B 21/04

* cited by examiner

*Primary Examiner* — Andrew Polay
(74) *Attorney, Agent, or Firm* — Dunlap Bennett & Ludwig PLLC; Brendan E. Squire

(57) ABSTRACT

A rope tender for a recreational watercraft is removably attached to the top of an outboard motor or a transom of the watercraft. The rope tender has a partial labyrinth slot which captively receive one or more anchor or mooring ropes to prevent entanglement of the ropes with the motor or propellers associated therewith. The rope tender may be conveniently removed and stowed when the watercraft is configured in an operational condition.

7 Claims, 3 Drawing Sheets

ROPE TENDER FOR WATERCRAFT

BACKGROUND OF THE INVENTION

The present invention relates to watercraft mooring and, more particularly, apparatus for securing mooring or anchoring ropes to prevent entanglement with a motor, propellers, or other structural members of the watercraft.

When mooring a watercraft, such as to a pier, dock, or anchoring, the watercraft is typically provided with cleats and other tie points for securing the mooring ropes to the watercraft. However, because the cleats are attached close to a surface of the watercraft, the ropes have a tendency to become entangled with a structural members and components of the boat as well as an outboard motor and propeller of the watercraft.

Moreover, given their close proximity to the surface of the watercraft, the ropes will lie across the painted surfaces of the watercraft. In this condition, the repeated movement of the watercraft on the waves of the water surface will have a tendency to mar the painted surfaces due to the repeated frictional contact of the ropes with the painted surfaces.

As can be seen, there is a need for an improved apparatus that can captively retain mooring ropes at an elevated position relative to the watercraft to avoid entanglement of the mooring ropes with the structural members and to prevent marring of the painted surfaces.

SUMMARY OF THE INVENTION

In one aspect of the present invention, a rope tender for a watercraft, includes an articulated rod that is operatively coupled to a first end of a cylindrical mounting shaft. The articulated rod defines a partial labyrinth slot configured for captively retaining one or more ropes for mooring the watercraft. A second end of the cylindrical mounting shaft is operatively coupled to a base portion. A mount is operatively coupled to the base portion and is configured for releasable attachment to the watercraft. In some embodiments, the articulated rod includes a bottom portion, and a first end of the articulated rod is bent inwardly at a first radius to overly the bottom portion and defines an opening there between. A second end of the rod is bent inwardly at a second radius that is substantially greater than the first radius, such that the second end overlies the first end and defines an opening there between. The first end has a length such that it extends towards and terminates before the second radius portion. A protective cap may be provided for covering the first end and the second end of the articulated rod.

In other embodiments, the bottom portion is received within a transverse slot defined in a top surface of the cylindrical mounting shaft. Preferably, the mount includes a suction cup, for removable attachment of the rope tender to a surface of the watercraft. One or more threaded shafts may extend from a bottom end of the cylindrical mounting shaft and are adapted to be received in one or more holes defined in a top surface of the base. A nut may be operatively coupled to the threaded shaft within an interior cavity of the base.

In yet other aspects of the invention, a flange extends around a periphery of a bottom end of the base. A plurality of apertures are defined in the flange and are aligned with a corresponding set of apertures defined in a top surface of the suction cup. The apertures are configured to receive a screw to secure the base to a top surface of the suction cup.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an improved rope tender for water craft that prevents the entanglement of ropes while operating a watercraft. The rope tender is particularly well suited for use with watercraft having outboard, and inboard-outboard motors mounted on the transom of the watercraft to avoid entanglement of the ropes with one or more propellers for such motors.

Figure 1:
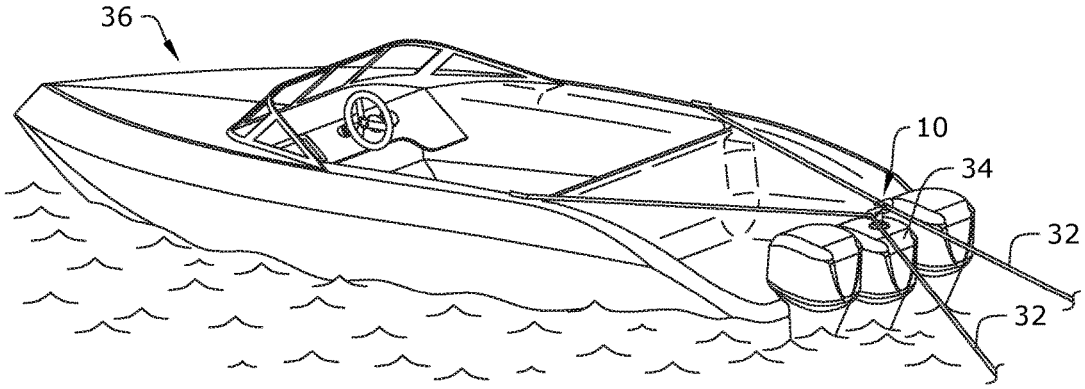
FIG. 1 is a perspective view of an embodiment of a rope tender apparatus.

As seen in reference to FIG. 1, the rope tender 10 of the present invention may be mountable to the top cowl of a transom mounted outboard motor 34 and a plurality of ropes 32, such as anchor or mooring ropes, may be conveniently routed through the rope tender 10 for securing the watercraft 36.

Figure 2:
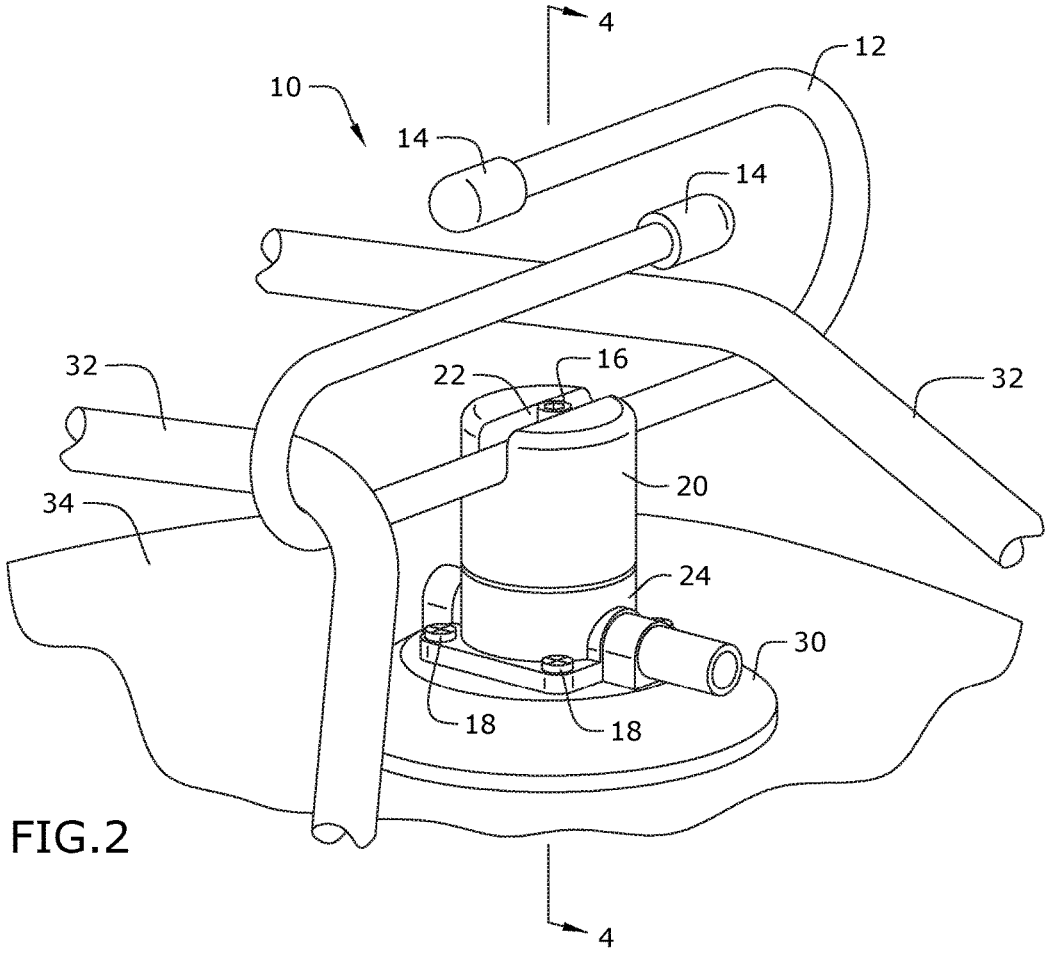
FIG. 2 is a perspective detail view of the rope tender shown in use.
Figure 3:
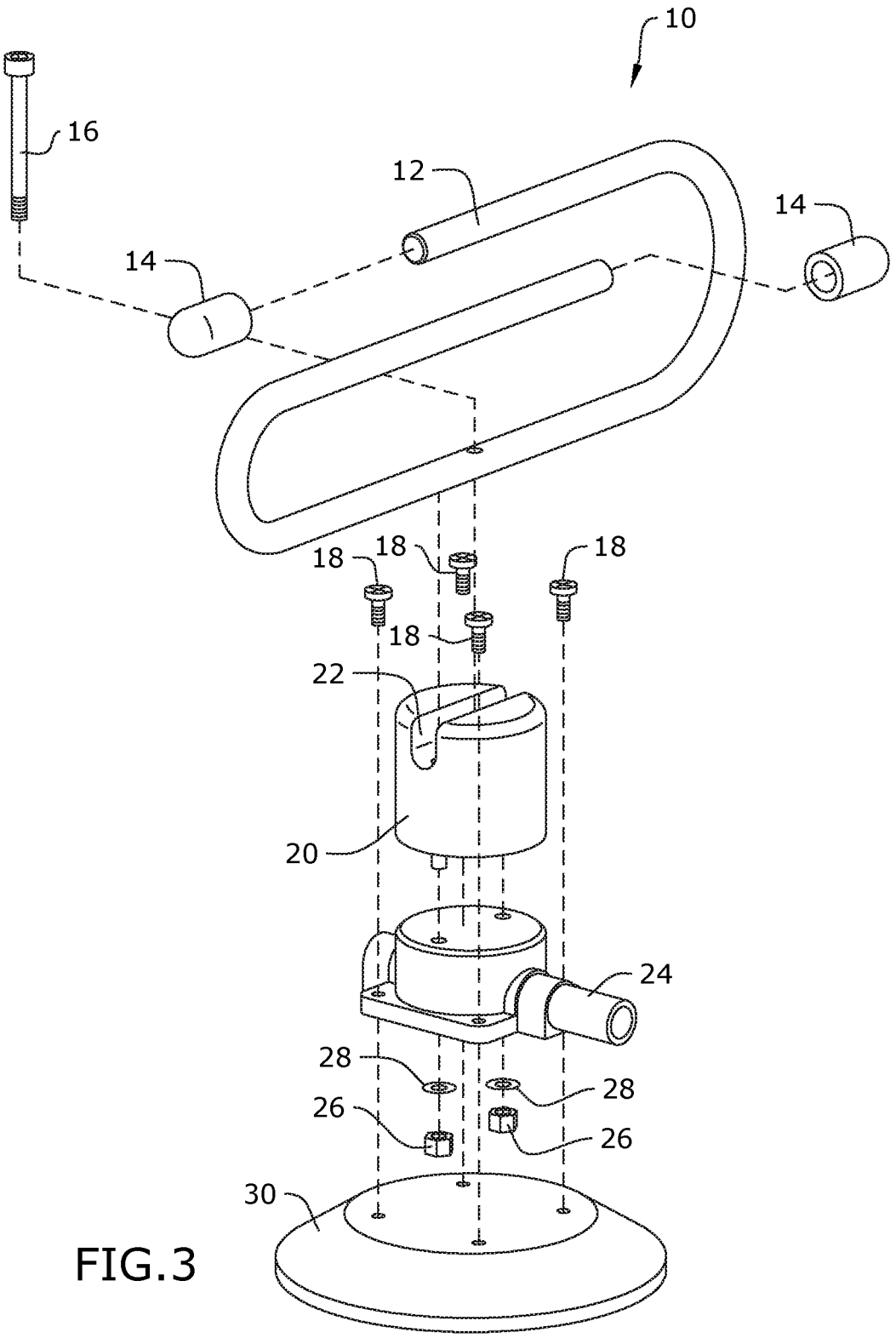
FIG. 3 is an exploded view of the rope tender.
Figure 4:
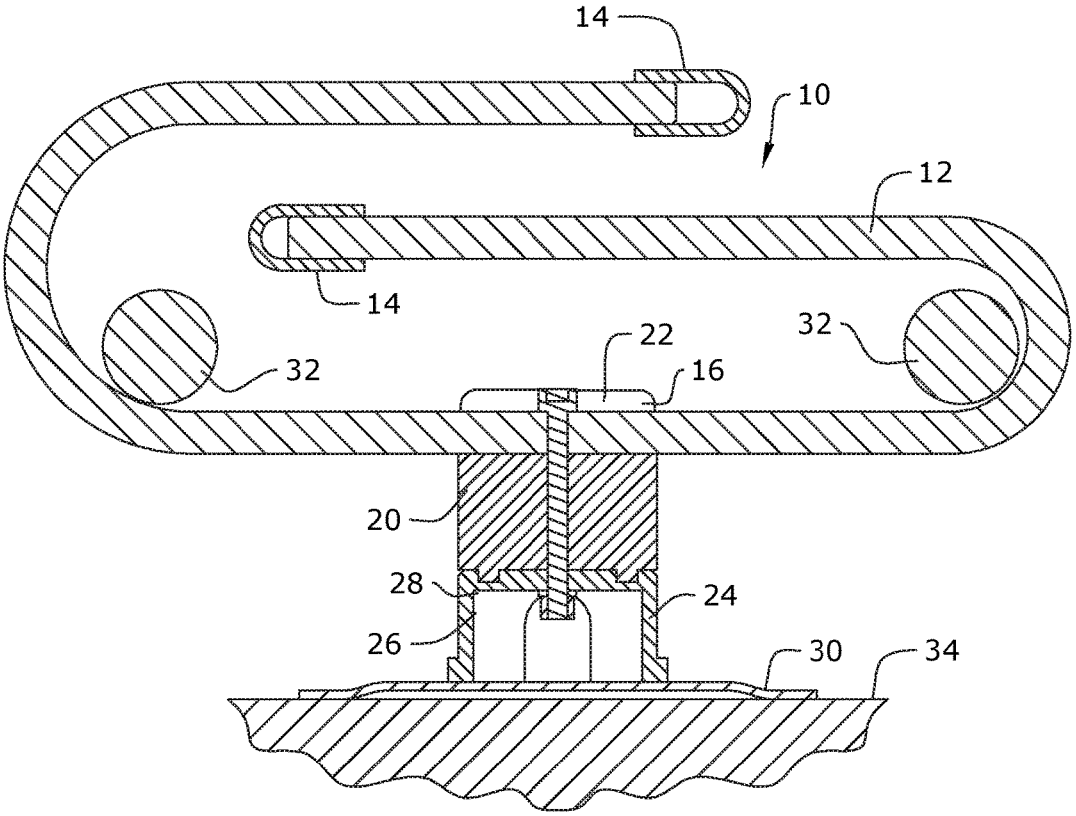
FIG. 4 is a section view of the rope tender taken along line 4-4 in FIG. 2.

As seen in reference to FIGS. 2-4, the rope tender 10 includes an articulated rod 12 that is operatively coupled to a first end of a cylindrical mounting shaft 20. A second end of the cylindrical mounting shaft 20 is operatively coupled to a base portion 24. The base portion 24 is configured to be removably attached to the top of the outboard motor 34 via a mount 30, or to a transom of the watercraft 36, such as with an inboard-outboard motor configuration. Preferably, the mount 30 includes a suction cup.

The articulated rod 12 may be formed by bending a tubular metallic rod, or may alternatively be a molded configuration. Preferably the rod 12 is made of stainless steel or other marine grade material to prevent oxidation. The articulated rod 12 includes a bottom portion that is received within a transverse slot 22 defined in a top end of the cylindrical mounting shaft 20. It may be secured by a fastener, such as a setscrew 16, which extends through a hole through the bottom portion and threadingly received within a hole defined into the cylindrical mounting shaft 20 within the slot 22.

A first end of the articulated rod 12 is bent inwardly at a first radius to overly the bottom portion and define an opening there between. A second end of the articulated rod 12 is bent inwardly at a second radius that is substantially greater than the first radius, such that the second end overlies the first end and defines an opening there between. The first end has a length such that it extends towards and terminates before the second radius portion. The ends of the articulated rod 12 may be covered by a protective cap 14 to prevent damage to the ropes 32 as they are routed about the ends of the articulated rod 12. As best seen in reference to FIG. 4, the articulated rod 12 is formed to define a partial labyrinth slot for receiving the ropes 32.

The cylindrical mounting shaft 20 may include one or more threaded shafts 21 extending from a bottom end of the cylinder that are adapted to be received in a one or more defined in a top surface of the base. The threaded shafts 21 may be secured with a nut 26 and washer 28 combination within an interior cavity of the base 24.

The base 24 may include a flange 29 extending around a periphery of the bottom end of the base 24. A plurality of apertures are defined in the flange 29 and are aligned with a corresponding set of apertures defined in a top surface of the suction cup 30. The apertures are configured to receive a screw 18 to secure the base to a top surface of the suction cup 30.

In use, the rope tender 10 of the present invention may be conveniently placed upon the top of the outboard motor 34, or transom of a watercraft and removably secured via the suction cup 30. The mooring or anchoring ropes 32 may be readily received within the partial labyrinth slot of the articulated rod 12 where they are captively retained. The positioning of the articulated rod 12 at an elevated position relative to the motor by the cylindrical shaft 20 ensures that the ropes 32 do not become entangled with the motors 34 or associated propellers while the watercraft remains moored or anchored.

When the user is ready to place the watercraft 36 in an operational condition, the ropes 32 may be readily removed from the articulated rod 12, coiled and appropriately stowed. The suction cup 30 may be released from a mounted condition on the watercraft motor 24 and the rope tender 10 may secured in a suitable location out of the way for the user to enjoy operation of the watercraft on the water. The rope tender 10 of the present invention can be also used to keep shore power cords up off the boat, to organize recreational equipment, such as dive mask, flippers, and the like, and otherwise to keep ropes from chafing on the watercrafts finish.

It should be understood, of course, that the foregoing relates to exemplary embodiments of the invention and that modifications may be made without departing from the spirit and scope of the invention as set forth in the following claims.

What is claimed is:

1. A rope tender for a watercraft, comprising:

a rod having a bottom portion operatively coupled to a first end of a cylindrical mounting shaft, the rod defining an elongate partial labyrinth slot configured for captively retaining one or more ropes for mooring the watercraft, a first end of the rod is bent at a first radius to extend laterally inwardly to overly the bottom portion and define an opening there between;

a second end of the rod is bent at a second radius that is substantially greater than the first radius to extend laterally inwardly such that the second end overlies the first end so that a terminal portion of the first end is disposed between a terminal portion of the second end and the bottom portion;

a second end of the cylindrical mounting shaft operatively coupled to a base portion; and a mount operatively coupled to the base portion, the mount configured for releasable attachment to the watercraft.

2. The rope tender of claim 1, wherein the first end has a length such that it extends towards and terminates before the second radius portion.

3. The rope tender of claim 2, further comprising:

a protective cap covering the first end and the second end of the rod.

4. The rope tender of claim 1, wherein:

the bottom portion is received within a transverse slot defined in a top surface of the cylindrical mounting shaft.

5. The rope tender of claim 1, wherein the mount comprises a suction cup.

6. The rope tender of claim 5, further comprising:

one or more threaded shafts extending from a bottom end of the cylindrical mounting shaft that are adapted to be received in one or more holes defined in a top surface of the base; and a nut operatively coupled to the threaded shaft within an interior cavity of the base.

7. The rope tender of claim 6, further comprising:

a flange extending around a periphery of a bottom end of the base;

a plurality of apertures defined in the flange aligned with a corresponding set of apertures defined in a top surface of the suction cup, wherein the apertures are configured to receive a screw to secure the base to a top surface of the suction cup.

* * * * *